United States Patent [19]

Bennett et al.

[11] 4,372,129

[45] Feb. 8, 1983

[54] FAIL-SAFE REFRIGERATION FOR CONTINUOUS PROCESS

[75] Inventors: Benjamin R. Bennett, West Covina; Leroy D. McBee, Brea; Richard F. Horak, Fullerton, all of Calif.

[73] Assignee: Moore & Hanks Co., South El Monte, Calif.

[21] Appl. No.: 265,183

[22] Filed: May 19, 1981

[51] Int. Cl.[3] ..... F25B 7/00; F25D 17/02

[52] U.S. Cl. ..... 62/175; 62/185

[58] Field of Search ..... 62/228 D, 175, 185, 62/510

[56] References Cited

U.S. PATENT DOCUMENTS 4,233,817 11/1980 Toth ..... 62/175

*Primary Examiner*—William E. Wayner

*Attorney, Agent, or Firm*—William H. Maxwell

[57] ABSTRACT

Fail-safe refrigeration comprised of dual mechanical refrigeration systems and an interdependent control responsive to a failure of a primary system being operated, for automatically placing the other a secondary system into immediate operation, whereby servicing and periodic inspection is conducted with refrigeration continuity, the primary system being manually returned into operation.

8 Claims, 5 Drawing Figures

(SECONDARY OPERATION)

FAIL-SAFE REFRIGERATION FOR CONTINUOUS PROCESS

BACKGROUND

Mechanical refrigeration is subject to unpredictable failure and requires periodic maintenance. Consequently, there are shut-downs of refrigeration equipment which cannot be avoided from time to time, it being shut-downs which are acceptable with the invention as it is herein disclosed for use in situations where interruption in refrigeration cannot be tolerated. For example, a near freezing or extremely low temperature must be maintained without failure in certain methods and processes; such as in the preservation of cadavers and embalming processes therefor involving solutions at freezing temperature. It is a general object of this invention to provide for continuity in the prolonged application of said near freezing or extremely low temperature to methods and processes which cannot tolerate interruptions and/or variation in the withdrawal of heat.

The logistics of the present invention is to provide duplication of the basic refrigeration system with controls therefor, by which a primary system may be shut down automatically and the other secondary system put into operation in lieu thereof. The transfer of operation from the primary system to the secondary system is automatic in response to sensors in the major system functions, while the transfer from secondary to primary is manual. In practice, there are manual transfer switches for deliberate manipulation of the controls and selective operation of either system, and there are pressure operated switches that respond to such functions as (1) excessive system pressure, (2) loss of refrigerant, and (3) loss of heat transfer media; for automatic protection of each system. Each of the two systems has its sensors responsive to these functions. In practice, therefore, the primary system is the normally operable system and in the event of a failure or abnormal condition therein affecting the aforesaid functions (1-3) there is an automatic transfer of operation to the other or alternate secondary system. As will be described, there are distinguishable indicator lights and an alarm to warn of the malfunction of the one primary system and automatic transfer of operation to the other secondary system.

The dual refrigeration system employed herein for the processing of cadavers and the like involves a tank or vat in which the processed body is immersed into a low temperature solution that remains fluid by virtue of its low freezing point. The vat walls transfer the heat into a heat transfer media such as water-glycol, and in practice the vat is double walled so that the heat transfer media has coextensive contact with the inner wall of the vat, the outer wall being insulated.

SUMMARY OF THE INVENTION

This invention relates to continuous refrigeration and to this end it provides a dual system with manual and automatic controls responsive to major system failures so as to immediately change operation from one complete refrigeration system to another, presenting an alert of this changeover and thereafter making possible servicing and/or breakdown repair while the takeover system continues to operate. Among the major system failures are excessive system pressure, and loss of fluid and/or pressure thereof, and any other malfunction which need be monitored and responded to under certain circumstances. As will be described, the function sensors are connected in electrical latching circuits in each system, so as to be additive as circumstances require. Consequently, continuity of operation is ensured insofar as refrigeration is concerned, and service and repair can be safely conducted at any time.

The foregoing and other various objects and features of this invention will be apparent and fully understood from the following detailed description of the typical preferred form and application thereof, throughout which description reference is made to the accompanying drawings.

Figure 5:
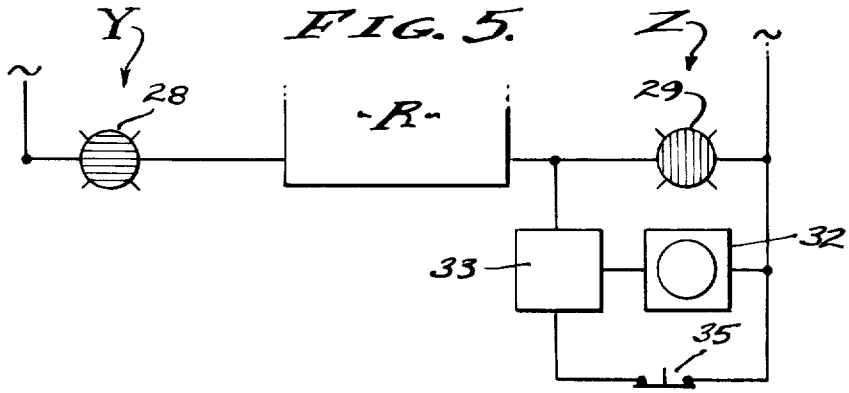

And, FIG. 5 is an electrical schematic of the malfunction sensors and visual and audible alarm for indicating transfer of operations.

PREFERRED EMBODIMENT

Referring now to the drawings, there is a double walled vat X and an attached housing H that accommodates two refrigeration systems, a primary system Y and a secondary system Z. The vat is double walled for the circulation of heat transfer media therethrough from a supply line 10 to a discharge line 11. The inner wall 12 contains the process solution 13 and the outer wall 14 is sheathed with insulation 15. There is a temperature sensor T1 at the inlet of line 10 and there is temperature sensor T2 at the outlet line 11. The sensors T1 and T2 open and close electrical switch contacts and are used for modulating motorized control valve V3 or V4 of the separate systems, as will be described.

Figure 1:
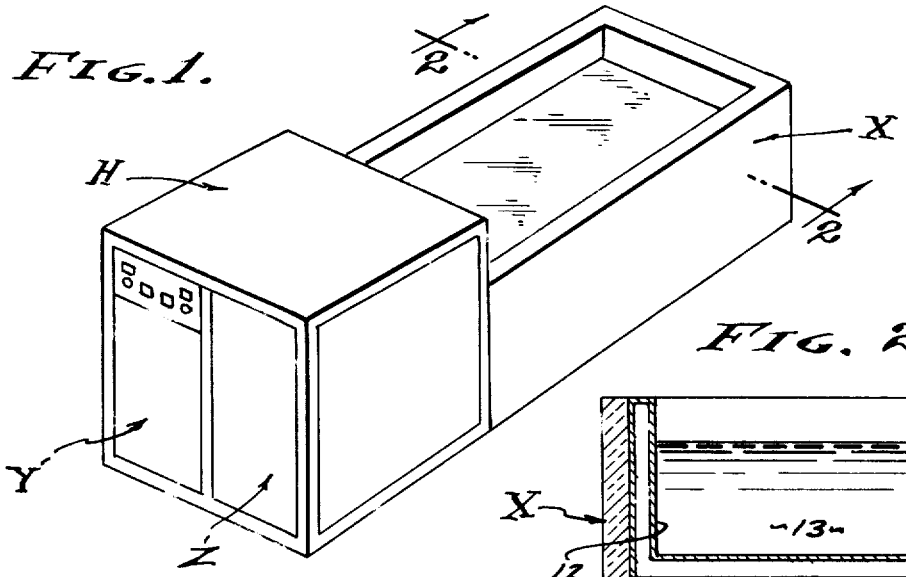
FIG. 1 is a perspective view of a cooling vat (cover removed) and the dual system fail-safe refrigeration combined therewith as a unit.
Figure 2:
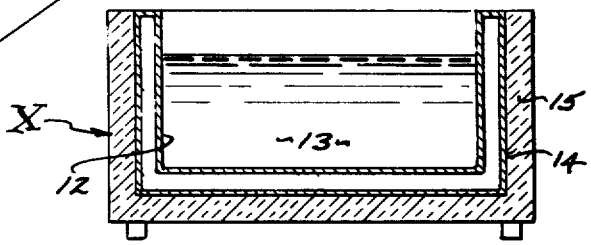
FIG. 2 is a sectional view taken as indicated by line 2—2 on FIG. 1.
Figure 3:
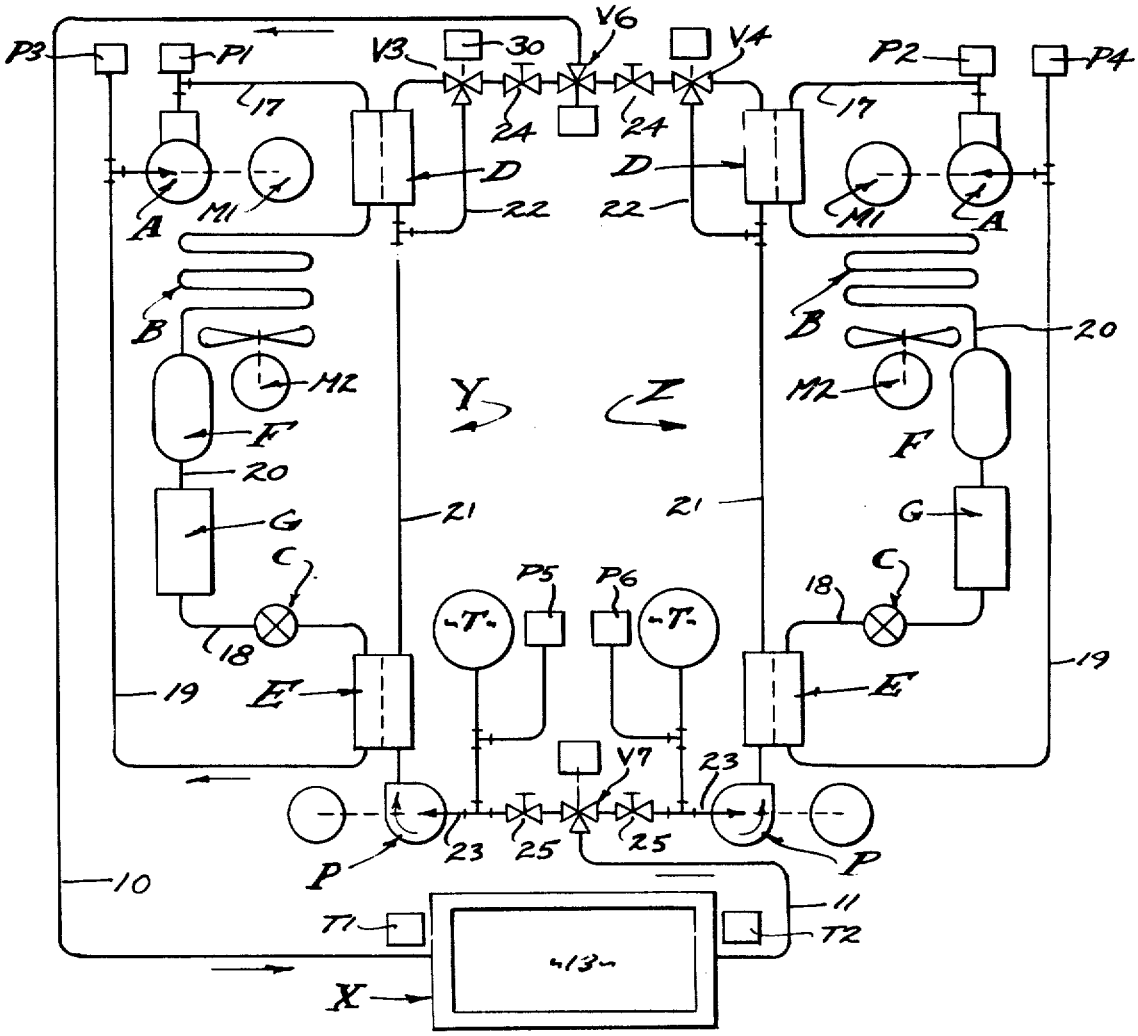
FIG. 3 is a diagrammatic view of the dual refrigeration systems as they are combined herein.

The two primary and secondary refrigeration systems are preferably identical as shown in FIG. 3 of the drawings, each comprised generally of a compressor A, a condenser B, and an expansion valve C. Heat absorption is applied through a water-glycol heat transfer media circulated by a pump P through a heating exchanger D disposed in a line 17 between the compressor A and condenser B, and through a cooling exchanger E disposed in a line 18 between the expansion valve C and a recirculation line 19 into the compressor A. There is a receiver F and a dryer G in a line 20 between the condenser B and expansion valve C.

Each system Y and Z is motorized by a motor M1 to drive the compressor B for compressing the refrigerant, and a motor M2 to drive a fan for air circulation through the condenser B. And in accordance with this invention, the primary system Y is protected by a pressure sensor P1 in line 17 for detecting abnormally high system pressure and is also protected by a pressure sensor P3 in recirculation line 19 for detecting loss of refrigerant gas; and the secondary system Z is protected by a pressure sensor P2 in line 17 for detecting abnormally high system pressure and is also protected by a pressure sensor P4 in recirculation line 19 for detecting loss of refrigerant gas. As shown, the systems Y and Z are independently operable.

Heat transfer from the water-glycol media is through cooling exchanger E and temperature control thereof is through heating exchanger D. The pump P of primary system Y has a delivery line 21 in series through the exchangers E and D and to the modulating valve V3, while the pump P of secondary system Z has a delivery line 21 through the exchangers E and D and to the modulating valve V4. In each system Y and Z the delivery line 21 has a by-pass 22 around the heating exchanger D and to the said modulating valves V3 and V4 respectively, thereby to control the delivery of heat transfer media to the supply line 10. The modulating valves V3 and V4 are alternately under control of the temperature sensors T1 and T2, and discharge line 11 is through a suction line 23 into pump P, there being an expansion tank T in line 23 for supplementing fluid media as required. In accordance with this invention a liquid sensor P5 is in the line 23 of system Y and a sensor P6 is in the line 23 of system Z. Shut-off valves 24 and 25 close the discharge line 21 and suction line 23 when a system is to be serviced, manual valves as indicated.

Figure 4:
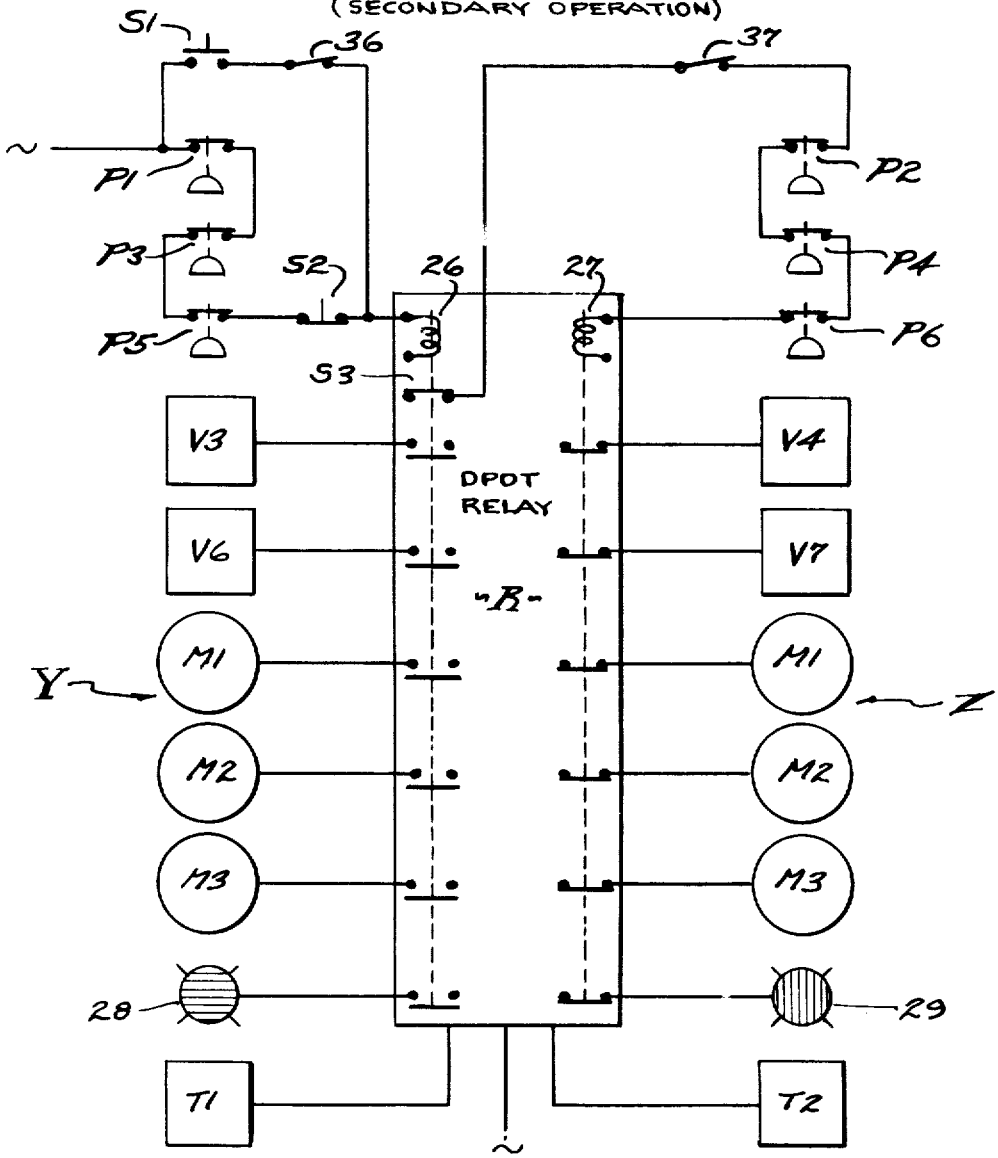
FIG. 4 is a block diagram of the electrical control system that integrates the dual refrigeration systems shown in FIG. 3.

In accordance with this invention, the delivery shut-off valves 24 of the two systems Y and Z discharge into a transfer valve V6 that opens via line 10 into and through the vat X, and the suction shut-off valves 25 of the two systems Y and Z draw from a transfer valve V7 that opens via line 11 from the vat X. The valves V6 and V7 are motorized and responsive to the sensors P1 through P6 to render the two systems Y and Z alternately operable. That is, only one system is operable at a time. Accordingly, the electrical control means of FIG. 4 of the drawings is provided and comprised of a switching relay means R responsive to any one of the aforementioned sensors P1 through P6 and adapted to alternately direct heat transfer media through and to alternately power either system Y or Z as circumstances require.

The switching relay means R is a double throw latching relay having an operating coil 26 energized by a normally closed latching circuit through the sensors P1, P3 and P5 to simultaneously activate the primary refrigeration system Y; and having an operating coil 27 energized by a normally closed latching circuit through the sensors P2, P4 and P6 to simultaneously activate the secondary refrigeration system Z and deactivate the primary refrigeration system Y. The relay means R has two operative latched positions, a primary operative position closing the switch R circuitry to perform the following functions: (1*a*) opening the transfer valve V6 from modulating valve V3 of system Y and into the delivery line 10, (2*a*) opening the transfer valve V7 from discharge line 11 and into suction line 23 of system Y, (3*a*) putting the modulating valve V3 under control of sensors T1 and T2, and (4*a*) putting the motors M1, M2 and M3 of system Y into operation; and a secondary operative position closing the switch R circuitry to perform the following alternate functions: (1*b*) opening the transfer valve V6 from modulating valve V4 of system Z and into delivery line 10, (2*b*) opening the transfer valve V7 from discharge line 11 and into suction line 23 of system Z, (3*b*) putting the modulating valve V4 under control of sensors T1 and T2, and (4*b*) putting the motors M1, M2 and M3 of system Z into operation. Manual push button swiches S1 and S2 are also provided in the coil circuit 26 so as to manually start and stop the primary refrigeration system Y and to transfer operation between the two refrigeration systems Y and Z. In the first primary operative position, the relay means R closes a circuit to an indicator light 28 (blue) to show operation of system Y, and alternately in the secondary operative position the relay means R closes a circuit to an indicator light 29 (red) to show operation of the system Z.

The double pole double throw relay switch R is motivated into said primary operative position by energizing the coil 26, and into said secondary operative position by energizing the coil 27. The coil 26 is in a series latching circuit through normally closed contacts of the sensors P1, P3 and P5, while the coil 27 is in a series latching circuit through normally closed contact of the sensors P2, P4 and P6. Manual closing of switch S1 (momentarily) closes and latches the coil 26 circuit, and manual closing of switch S2 (momentarily) opens and unlatches the coil 26 circuit; and consequently the primary refrigeration system is adapted to be manually controlled. However, operation of the secondary refrigeration system is automatic and under control of relay switch contacts S3 opened when coil 26 is energized to operate the primary refrigeration system, and permitting the contacts S3 to close, as shown. The switch contacts S3 are in the series latching circuit through the normally closed contacts of sensors P2, P4 and P6 to coil 27, so that the secondary refrigeration system Z is automatically put into operation when the primary system Y is dropped and put out of operation.

A feature is the capacity of sensors P2, P4 and P6 which protects the secondary refrigeration system from malfunction, and the requirement of manual return to primary system operation. In this way, the secondary system is seldom used and the maintenance and repair of the primary system enforced. Accordingly, the secondary system remains substantially unused and in good repair and therefore in readiness for reliable takeover.

The indicator lights and alarm functions are shown by the schematic of FIG. 5, as related to the relay means R. As described above, the double throw relay means R latches in either of two positions, thereby activating refrigeration systems Y or Z as may be required manually or automatically and as required by malfunction detected by any one of the sensors P1, P3 or P5. Consequently, either indicator light is energized together with an audible alarm in the form of a buzzer 32 (Son-Alert) that is energized when the relay means R switches from the primary system Y to the other secondary system Z. As shown in FIG. 5, there is a buzzer 32 and holding relay 33 in parallel with the red indicator light 29 showing operation of system Z. The holding circuit of relay 33 has a normally closed button switch 35, said switch being manually opened so as to stop the audible alarm.

It is to be understood that the electrical components employed herein are state of the art off-the-shelf items, including the relays, motor controllers, valve modulators and sensors etc. These electrical components are wired according to their manufactured requirements and wired into the circuits as shown herein which are necessary to this invention. Temperature control over the heat transfer media is by means of the sensors T1 and T2 which govern the motor controller 30 to position the modulator valve V3. As shown, the essential and vital functions of the two refrigeration systems Y and Z involve the pressence of fluids and the pressure thereof, in which case the aforesaid sensors therefor are pressure responsive as indicated diagrammatically in FIG. 4 of the drawings.

From the foregoing it will be seen that a fail-safe refrigeration is provided. Continuity of operation is paramount as is longevity of the dual system equipment which permits alternate periodic servicing of the two separate refrigeration systems. Reliable operation of the separate systems is ensured, and in the event of an occurrence of any one of the three aforementioned major malfunctions damage to the operating system is avoided, minor adjustment or repair or replenishment of fluids is all that is necessary. The out of service system can be isolated by closing the valves 24 and 25 thereof, and the energy source thereto can be cut off from each of the functional motors or as shown by means of switches 36 and 37 in the circuits of relay coils 26 and 27. Thus, the systems Y or Z are rendered safe for service and/or repair as and when required, while an alternate system Y or Z continues to operate.

Having described only a typical preferred form and application of our invention, we do not wish to be limited or restricted to the specific details herein set forth, but wish to reserve to ourselves any modifications or variations that may appear to those skilled in the art as set forth within the limits of the following claims.

We claim:

1. Fail-safe refrigeration for continuous processes and including in combination;

dual refrigeration means comprised of primary and secondary mechanical heat absorption systems and each operable independently of the other to absorb heat from a mass required to remain continuously refrigerated, each system being comprised of a compressor means, a condenser means, an expansion means and a power means to operate the same, whereby heat absorption is effected through the expansion of a compressed refrigerant fluid to chill said mass, a reversible transfer valve means alternately applying the heat absorption effect of one of the heat absorption systems to said mass, and failure responsive control means comprised of at least one condition responsive means in the dual refrigeration means and adapted to sense a malfunction thereof, and a double pole double throw relay that switches in response to the condition responsive means at one heat absorption system to alternately operate the power means of the primary and secondary heat absorption systems and to reverse the transfer valve means to reverse operation from one heat absorption system to the other.

2. Fail-safe refrigeration for continuous processes and including in combination;

dual refrigeration means comprised of primary and secondary mechanical heat absorption systems and each operable independently of the other and comprised of a compressor means, condenser means, an expansion means, and a power means to operate the same, whereby heat absorption is effected through the expansion of a compressed refrigerant fluid, a heat exchange means transferring heat of absorption from a fluid heat transfer media and into said refrigerant fluid of each absorption system to absorb heat from a mass required to remain continuously refrigerated, and means to circulate the heat transfer media therethrough, a reversible transfer valve means in communication with each of the heat exchange means and alternately applying the heat absorption effect of one of the heat absorption systems to said mass, and failure responsive control means comprised of at least one condition responsive means in the dual refrigeration means and adapted to sense a malfunction thereof, and a double pole double throw relay that switches in response to the condition responsive means at one heat absorption system to alternately operate the power means of the primary and secondary heat absorption systems and to reverse the transfer valve means to direct heat transfer media to chill said mass and to reverse operation from one heat absorption system to the other.

3. Fail-safe refrigeration for continuous processes and including in combination;

dual refrigeration means comprised of primary and secondary mechanical heat absorption systems and each operable independently of the other and comprised of a compressor means, a condenser means, an expansion means, and a power means to operate the same, whereby heat absorption is effected through the expansion of a compressed refrigerant fluid, a heat exchange means at each heat absorber system and comprised of a heat exchange transferring heat of absorption from a fluid heat transfer media and into said refrigerant fluid and a heat exchanger transferring heat of compression from the compressor means and into said refrigerant fluid, there being a modulator valve means in a by-pass around the last mentioned heat exchanger and responsive to temperature sensing means at a mass required to remain continuously refrigerated, and a pump means to circulate the heat transfer media therethrough, a reversible transfer valve alternately in communication from the modular valves of the dual heat absorption systems, and a reversible transfer valve alternately in communication into the pump means of the heat absorbing systems, said transfer valves alternately applying the heat absorption effect of one of the heat absorption systems to said mass, and failure responsive control means comprised of at least one condition responsive means in the dual refrigeration means and adapted to sense a malfunction thereof, and a double pole double throw relay that switches in response to the condition responsive means at one heat absorption system to alternately operate the power means of the primary and secondary heat absorption systems and to reverse the said transfer valves to direct heat transfer media to chill said mass and to reverse operation from one heat absorption system to the other.

4. The combination of means for fail-safe refrigeration as set forth in any one of claims 1, 5 or 3, wherein the relay is responsive to the said at least one condition responsive means comprised of a sensor responsive to excessive refrigerant fluid pressure.

5. The combination of means for fail-safe refrigeration as set forth in any one of claims 1, 5 or 3, wherein the relay is responsive to the said at least one condition responsive means comprised of a sensor responsive to the loss of refrigerant fluid.

6. The combination of means for fail-safe refrigeration as set forth in any one of claims 1, 5, or 3, wherein the relay is responsive to the said at least one condition responsive means comprised of a sensor responsive to the loss of heat transfer media.

7. The combinaion of means for fail-safe refrigeration as set forth in any one of claims 1, 5, or 3, wherein the relay is responsive to the condition responsive means including a sensor responsive to excessive system pressure, a sensor responsive to loss of refrigerant, and a sensor responsive to the loss of heat transfer media.

8. The combination of means for fail-safe refrigeration as set forth in any one of claims 1, 5, or 3, wherein the relay is responsive to the condition responsive means including a sensor responsive to excessive system pressure, a sensor responsive to loss of refrigerant, and a sensor responsive to the loss of heat transfer media, and wherein said sensors are in series latching circuits to actuating coils of double pole double throw relay.

* * * * *